United States Patent [19]

Wanner

[11] 4,055,932

[45] Nov. 1, 1977

[54] ENVELOPE-STUFFING MACHINE

[75] Inventor: Rudolf Wanner, Aystetten, Germany

[73] Assignee: Böwe Böhler & Weber KG Maschinenfabrik, Augsburg, Germany

[21] Appl. No.: 752,170

[22] Filed: Dec. 20, 1976

[30] Foreign Application Priority Data

Dec. 20, 1975 Germany ..... 2557670

[51] Int. Cl.[2] ..... B65B 57/06; B65B 43/30

[52] U.S. Cl. ..... 53/63; 53/386

[58] Field of Search ..... 53/63, 386

[56] References Cited

U.S. PATENT DOCUMENTS 3,427,780 2/1969 Bock ..... 53/63

3,750,365 8/1973 Darby et al. ..... 53/63 X

*Primary Examiner*—Travis S. McGehee

*Attorney, Agent, or Firm*—Karl F. Ross

[57] ABSTRACT

An envelope-stuffing machine adapted to insert sheets of paper or the like into an envelope or a folder comprises a pair of opposite perforated surfaces connected to a suction chamber and between which the envelope or folder is introduced so as to draw the opposite sides of the envelope or folder apart to receive the sheets to be inserted. A pressure sensor is provided to respond to the suction in the chamber communicating with the perforations of the surfaces to trigger the insertion of the sheets upon the detection of a predetermined reduced pressure in the chamber. The pressure sensor is of the threshold type.

10 Claims, 6 Drawing Figures

ENVELOPE-STUFFING MACHINE

FIELD OF THE INVENTION

The present invention relates to an envelope-stuffing machine and, more generally, to a machine for inserting sheets between the sides of a cover which can be drawn apart by suction to accommodate the sheets.

BACKGROUND OF THE INVENTION

Envelope-stuffing machines and, more generally, machines for inserting signatures, folded sheets or individual sheets, e.g., letters, into envelopes or between the sides of some other cover, e.g., a folder, generally comprise suction means for drawing apart the opposite sides of the cover to open the mouth thereof and permit the sheets to be inserted.

Reference can be made to German Pat. Nos. 706,317, and 963,125, for example, which provide suction means to open the envelope or some other cover to enable a transport device to introduce the unfolded or folded sheets into the envelope or cover. In the following description, the term "cover" is used generally to refer to an enclosure for paper sheets or the like which can be inserted through a mouth of the unit upon the spreading apart of the opposite sides thereof. Such covers include folders, folded sheets or letter or other envelopes.

In the aforedescribed machines, when the suction force is applied to open the cover or envelope, the transport of the sheets or folded pages to be inserted into the cover or envelope is initiated. These machines suffer, however, from the lack of any control which is intended to ensure transportation or insertion of the sheets into the envelope or cover when the letter is open but which prevents advance of the sheets to the mouth of the envelope or cover when the suction effect is incapable of opening the envelope.

Generally speaking it is the practice to provide mechanical members which are inserted into the opening of the envelope or cover to ensure that the latter is properly opened before the transport of the sheets or sheet to be inserted is commenced. The mechanical member frequently damages the envelope and may even slip so as to miss the opening entirely, thereby interrupting the envelope-stuffing process.

OBJECT OF THE INVENTION

It is the principal object of the present invention to provide a machine for the purposes described which renders the opening of the envelope reliable and enables the insertion of the sheet or sheets to be received therein only when the opening of the envelope is ensured, i.e., when the opposite sides of the envelope or cover are spread apart sufficiently by the suction means to enable proper insertion of the unfolded or folded sheet or sheets.

SUMMARY OF THE INVENTION

This object and others which will become apparent hereinafter are attained, in accordance with the present invention, in an envelope-filling machine which comprises a suction chamber communicating with the perforated surfaces confronting the opposite sides of the envelope or cover to be filled, and a threshold sensor responsive to the development of a predetermined suction in the chamber for initiating the insertion of the folded or unfolded sheets between the spread-apart sides of the envelope or cover. The present invention operates under the principle that, in the event the sides of the envelope are not drawn apart by the suction, the perforations of the surfaces will remain unblocked so that a sufficiently high level of vacuum cannot develop in the chamber. Conversely, when the sides of the envelope or cover are drawn apart sufficiently by the suction, a higher level of vacuum develops in the chamber-which can be sensed by the threshold-value sensor to trigger the insertion of the sheet or sheets.

The insertion process thus is initiated in dependence upon reduced pressure developed in the suction chamber. Consequently, the sheets are only inserted into the cover or envelope when the sides of the latter are in effective contact with the suction surfaces and are drawn against their openings.

According to a feature of the invention, a plurality of suction chambers are provided, the suction surfaces of each chamber confronting the opposite sides of the envelope or cover at different locations. In this case, each suction chamber is provided with a respective threshold-value sensor responsive to the level of suction in the chamber and having outputs which are applied to an AND gate which, in turn, triggers the insertion process. This ensures that only when the opening of the envelope or cover is complete will the folded or unfolded sheets be inserted.

According to another feature of the invention, the output signal from the threshold-value sensor or both threshold-value sensors activates the drive for the feed of the sheets advancing them into the open envelope or cover. In the simplest form of the invention, the threshold-value sensor is constituted as a switch which, upon attainment of a predetermined level of suction, switches on the drive for the insert transport mechanism. The switch, according to the invention, can be a membrane switch having a membrane which is displaced by the suction in the suction chamber to operate the switch contacts.

According to another feature of the invention, the membrane can be connected to a strain gauge whose output serves to activate the insert transport mechanism, this arrangement being equivalent to the switch described above. Other sensors having equivalent effects can also be used. For example, the sensor can be an extensometer. An electrical pressure sensor, using the piezoelectric effect, i.e., a crystal, can be employed to measure and indicate the attained reduced pressure in the suction chamber and to activate the transport mechanism for inserting the paper sheet.

In a preferred embodiment of the invention, the mechanism for effecting the feed of the paper sheets to be inserted into the envelope comprises an electromagnet whose armature is operatively connected to a stop for the inserts. The inserts engage this stop and are held in place while the transport rollers or surfaces are continuously operated to hold the inserts against the stop. The movably journaled surfaces can, in the simplest case, be rollers or conveyor bands. When the electromagnet is activated, the stop is withdrawn from the insert sheets so that the latter can be fed by the transport surfaces into the envelope or folder. The operation of the stop can be mechanically coupled to a displacement of one or more continuously rotating or driven transport surfaces so that the latter are urged against the insert to advance the same into the mouth of the cover formed by spreading the opposite sides thereof via the suction surfaces.

Still another feature of the invention resides in providing a time-delayed switching element, time-constant network, or other fixed-time control component which operates the insert transport means only for the desired period necessary to feed the insert into the envelope or cover. The transport mechanism can then be turned off under the control of the time-constant network or timing element so that the next insertion stage can be readied.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
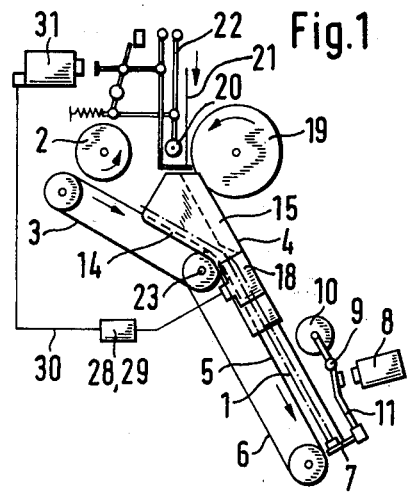
FIG. 1 is a diagrammatic side elevational view of a portion of an envelope-filling machine according to the invention.
Figure 2:
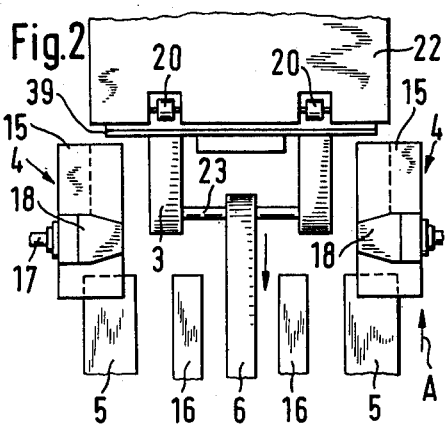
FIG. 2 is a partial elevational view of the machine of FIG. 1 as seen from the right, also in diagrammatic form.
Figure 5:
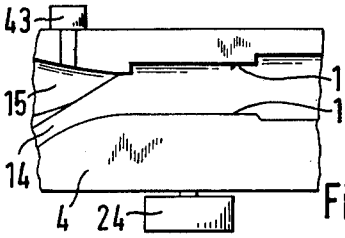
FIG. 5 is an elevational view of the device illustrated in FIG. 4, as seen from the left.

FIGS. 1 and 2 show the most significant parts of the device according to the present invention in the region of the sheet-insertion station. In FIG. 1, the position of the envelope 1 has been illustrated in broken lines. The envelope 1 is advanced by a feed-roller pair 2 and is transported via conveyor bands 3 running over further rollers in the direction of the arrow (FIG. 1) through a guide passage 14 (FIGS. 1 and 5) of a guide element 4. Two such guide elements 4 flank the filling station or insertion station of the machine (see FIG. 2).

In the insertion station, the lower part of the envelope 1 (or a folder or other cover as defined above) is positioned between a pair of lateral guide rails 5 which reach around the lateral edges of the envelope above the conveyor belt 6, the envelope being held against the support rails 16 and lying with its lower edge against an abutment 7.

The abutment 7 is displaceable by an electromagnet 8 about a pivot 9 from its illustrated rest position (FIG. 1) in the counterclockwise sense. The arm 11, carrying the abutment 7, also has a roller 10 journaled on its end remote from the abutment 7. Thus, when the abutment 7 is swung out of the path of the envelope, the roller 10 is pressed against the envelope to urge the latter against the conveyor 6 and cause its positive entrainment in the direction of th arrows in FIG. 1. The pressure of the envelope against the abutment 7 can, via means not shown, switch on the application of suction to the suction chambers.

In the illustrated position of the envelope (FIG. 1) the upper portion thereof is received between slit-like lateral guides which are provided with upper and lower suction surfaces 12 and 13, confronting the opposite broad sides of the envelope and forming part of respective suction heads 18. These perforated surfaces, juxtaposed with opposite sides of the envelope, have their perforations communicating with respective suction chambers 26.

Figure 3:
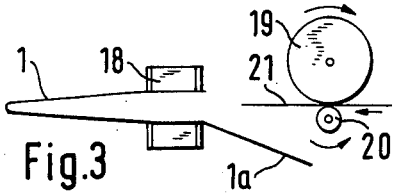
FIG. 3 is a schematic illustration of the principle of operation of the opening and insertion process according to the invention, viewed in a side cross section.

The flap 1*a* of the envelope or other cover 1, which can be folded over the mouth thereof, projects out of the suction heads 18 as can be seen in FIG. 3. This flap can be held by the slit-like guide channel 14 (FIGS. 1 and 6) outwardly out of the guide elements 4 above the conveyor belt 3.

Figure 4:
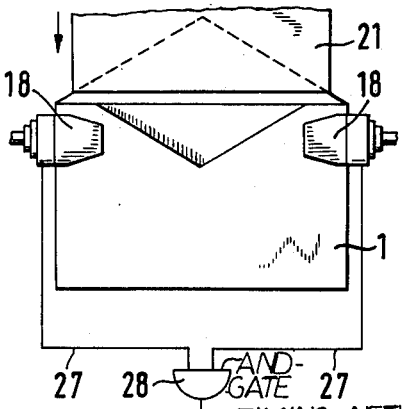
FIG. 4 is an elevational view, partly broken away, of a guide element according to the invention provided with a suction chamber and as seen in the direction of the arrow A in FIG. 1.
Figure 4:
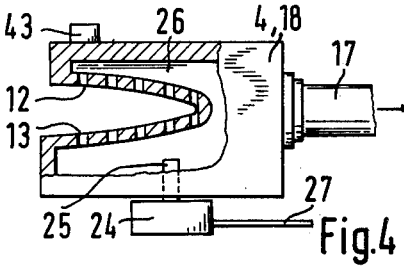

For clarity, the position of the suction head 18 in the individual guide elements 4 has been shown in solid lines while the suction duct 17, seen in FIGS. 2 and 4, has been omitted in FIG. 1.

When suction is applied via lines 17 to the respective chambers 26, the surfaces 2 and 13 draw the respective sides of the envelope apart and toward the surfaces to open the mouth of the envelope.

The paper-sheet inserts, whether folded or not, are fed along a guide plate 22 (see the vertical arrow in FIG. 1) by means of the rollers 20 which press in the direction of the continuously driven rollers 19 so that the insert can feed through the directly adjacent slit-like guide channel 15 into the guide element 4 and hence into the envelope 1 which has been opened as described (see FIG. 3). A shaft 23 carries the rollers for the conveyor belts 3 and 6 to drive the latter, the conveyor belt 6 lying between the rails 16 previously described (FIG. 2).

In order to initiate the insertion step according to the invention, the illustrated embodiment has each of its suction heads on opposite sides of the envelope 1 provided with a membrane switch whose pressure sensor 25 is exposed to the vacuum in the respective suction chamber 26 of each suction head 18.

When suction is applied, e.g. via a vacuum pump (not shown) to ducts 17, a measurable vacuum develops in the suction chambers 26 only upon contact of the opposite broad surfaces of the envelope with the suction surfaces 12, 13, thereby obturating the perforations of these surfaces. This occurrence means that the mouth of the envelope is fully open and results in a sharp rise in the level of vacuum in each suction chamber 26.

The increase in the suction level is detected by the respective sensors 25 which trip the switches 24 as the threshold suction levels are reached. The switches 24 transmit, via lines 27, signal voltages of predetermined polarity to the inputs of an AND gate 28.

Figure 6:
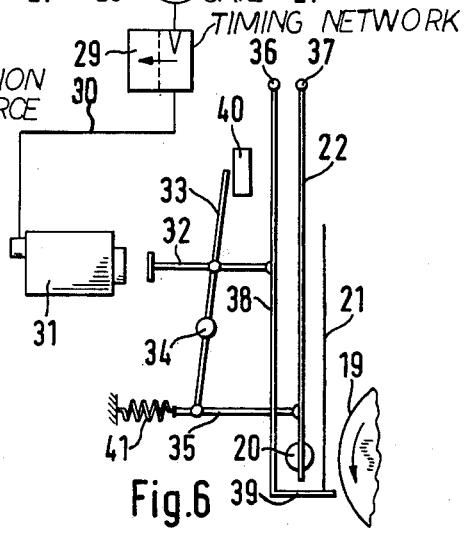
FIG. 6 is a schematic illustration of the control of the transport means for the insert into the envelope according to the invention.

When both vacuum chambers 26 have developed threshold vacuum levels sufficient to trip the switches 24, thereby signaling that the mouth of the envelope is fully open at both of its opposite sides received in the suction heads 18, AND gate 28 has an output signal which triggers a monostabile monovibrator 29 (MONOFLOP) to energize the electromagnet 31 (FIGS. 1 and 6).

The electromagnet 31 attracts its armature 32 and draws it to the left (FIG. 6) and, with it, the L-shaped angle plate 38. The latter is swingable about a fixed pivot 36 (perpendicular to the plane of the drawing).

The foot 39 of this plate 38 forms an abutment or stop for the paper-sheet inserts 21 which are fed downwardly until they engage the abutment 39 (FIGS. 1 and 6).

The armature 32 is also pivotally connected to a level 33 which is fulcrumed at 34 about a horizontal axis perpendicular to the plane of the drawing (FIG. 6). At its lower end, this level 33 is articulated to a rod 34 biased to the left by a spring 42 and it is hinged to plate 22. Plate 22 is swingable at its upper end about a horizontal axis 37 (perpendicular to the plane of the paper in FIG. 6).

When electromagnet 31 is not energized (FIGS. 1 and 6), the spring 41 holds the upper end of lever 33 against a fixed stop 40. At its lower end the plate 22 carries the pair of freely rotatable pressure rollers 20 described previously.

When the magnet 31 draws its armature 32 to the left, the lever 33 via the rod 35 simultaneously swings the plate 22 in the counterclockwise sense about its pivot 37, thereby urging the rollers 20 to the right (FIGS. 1 and 6) while the angle plate 38 is swung in the clockwise sense about it pivot 36 to retract the foot 39 from its position illustrated, thereby causing the bottom of the paper insert 21 to be pressed against the continuously driven roller 19 and advance into the guide channel 15 and thus into the open envelope 1 (FIGS. 1 and 3).

In the illustrated embodiment, the guide channel 15 (FIG. 5) is provided with a conventional light curtain 43 A which is interrupted when the paper insert passes and shortly thereafter briefly energizes the magnet 8. The latter attracts the lever 11 to rotate the same in the counterclockwise sense, withdrawing the abutment 7 from the bottom of the envelope and pressing the roller 10 against the latter so that the envelope is now filled, is urged against the conveyor belt 6 and can be displaced to a flap closing station. The light curtain 43 can also trigger a valve to cut off the application of suction to the heads 18 until a new envelope comes to rest against the abutment 7. The monoflop 29 is formed as a time constant circuit which energizes the transport rollers 19, 20 only for a period sufficient to advance the insert into the envelope.

Of course, the electrical and mechanical components of the system for controlling the insertions of sheets into the envelope in response to the vacuum in the suction chambers can be modified in various ways without departing from the spirit and scope of the invention as defined in the appended claims. To this extent, therefore, the invention is not limited to the specific embodiment illustrated and described.

What is claimed is:

1. A machine for introducing an insert between spreadable sides of a cover forming a mouth to receive said insert upon the spreading of said sides, said machine comprising:

means for displacing said cover into an insertion station;

a suction head at said station having a pair of perforated suction surfaces juxtaposed with the respective sides of a cover disposed at said station, a suction chamber cmmunicating with the perforations of said surfaces, and means for evacuating said chamber whereby the suction generated at said surface spreads said sides and undergoes an increase in suction level upon contact of said sides with said surfaces;

a transport mechanism for feeding said insert into the mouth of said cover formed upon spreading of said sides;

a threshold-value sensor responsive to the suction level in said chamber; and circuit means connecting said sensor to said mechanism for activating same to introduce said insert into said cover upon the development of a predetermined vacuum level in said chamber.

2. The machine defined in claim 1 wherein a pair of said suction heads each with respective suction surfaces and suction chamber are disposed along opposite edges of said cover and each of said chambers is provided with a respective such sensor, said circuit means including an AND gate, said sensors being connected to the inputs of said AND gate, the output of said AND gate activating said mechanism.

3. The machine defined in claim 1 wherein said mechanism includes an electrically responsive element, said sensor energizing said element.

4. The machine defined in claim 3 wherein said sensor is a switch connected in circuit with said element.

5. The machine defined in claim 3 wherein said element is an electromagnet and said mechanism includes an abutment temporarily retaining said insert and a pressure roller adapted to press said insert against a continuously driven transport surface, and lever means connecting said abutment and said pressure roller to an armature of said electromagnet whereby said abutment is withdrawn from engagement with said insert simultaneously with the pressing of said insert against said continuously driven surface by said pressure roller.

6. The machine defined in claim 1 wherein said circuit means includes timing means for operating said mechanism in response to said sensor only for a predetermined period sufficient to introduce said insert into said cover.

7. The machine defined in claim 2 wherein said mechanism includes an electrically responsive element, said AND gate energizing said element.

8. The machine defined in claim 7 wherein said element is an electromagnet and said mechanism includes an abutment temporarily retaining said insert and a pressure roller adapted to press said insert against a continuously driven transport surface, and lever means connecting said abutment and said pressure roller to an armature of said electromagnet whereby said abutment is withdrawn from engagement with said insert simultaneously with the pressing of said insert against said continuously driven surface by said pressure roller.

9. The machine defined in claim 8 wherein said circuit means includes timing means for operating said mechanism in response to said AND gate only for a predetermined period sufficient to introduce said insert into said cover.

10. The machine defined in claim 9 wherein said timing means is a monostable multivibrator.

* * * * *